US007731326B2

(12) United States Patent
Perez et al.

(10) Patent No.: US 7,731,326 B2
(45) Date of Patent: Jun. 8, 2010

(54) STORAGE SYSTEM

(75) Inventors: Raul Perez, San Marcos, CA (US); Edward P. Maher, Oceanside, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 719 days.

(21) Appl. No.: 11/256,248

(22) Filed: Oct. 21, 2005

(65) Prior Publication Data

US 2007/0091155 A1 Apr. 26, 2007

(51) Int. Cl.
*B41J 2/165* (2006.01)

(52) U.S. Cl. ..... 347/29; 347/32

(58) Field of Classification Search ..... 347/29, 347/32, 33, 49, 85
See application file for complete search history.

(56) References Cited

U.S. PATENT DOCUMENTS

| | | | | |
|---|---|---|---|---|
| 5,289,213 | A | 2/1994 | Murai | |
| 5,667,063 | A | 9/1997 | Abe | |
| 5,805,181 | A | 9/1998 | Tanaka et al. | |
| 5,929,883 | A * | 7/1999 | Gunther et al. | 347/85 |
| 6,027,209 | A | 2/2000 | Menendez et al. | |
| 6,047,816 | A | 4/2000 | Moghadam et al. | |
| 6,097,407 | A | 8/2000 | Terasawa et al. | |
| 6,123,421 | A | 9/2000 | Bartolome et al. | |
| 6,132,037 | A | 10/2000 | Bartolome et al. | |
| 6,183,077 | B1 * | 2/2001 | Hmelar et al. | 347/86 |
| 6,199,973 | B1 | 3/2001 | Bartolome et al. | |
| 6,247,598 | B1 * | 6/2001 | Hosaka et al. | 206/723 |
| 6,533,405 | B1 | 3/2003 | Sleger | |
| 6,893,109 | B1 | 5/2005 | Silverbrook | |
| 6,971,740 | B2 * | 12/2005 | Yuen | 347/85 |
| 7,207,666 | B2 * | 4/2007 | Ord et al. | 347/85 |
| 2002/0135645 | A1 | 9/2002 | Barinaga | |

FOREIGN PATENT DOCUMENTS

| | | | |
|---|---|---|---|
| EP | 0900662 | | 3/1999 |
| GB | 2394445 | | 4/2004 |
| JP | 10194334 | * | 7/1998 |
| JP | 2003251825 | * | 9/2003 |

OTHER PUBLICATIONS

International Search Report dated Nov. 22, 2006 for PCT/US2006/029844, Hewlett-Packard (4 pages).

* cited by examiner

*Primary Examiner*—Anh T. N. Vo

(57) ABSTRACT

Various embodiments of a storage system are disclosed.

30 Claims, 6 Drawing Sheets

STORAGE SYSTEM

BACKGROUND

In some printing systems, imagers are provided with replaceable printheads that may be dedicated to one or more inks. To print with a different ink, the printhead may be removed from the imager. When not being used by the imager, the printhead may dry out or become damaged unless properly stored.

DETAILED DESCRIPTION OF THE EXAMPLE EMBODIMENTS

Figure 1:
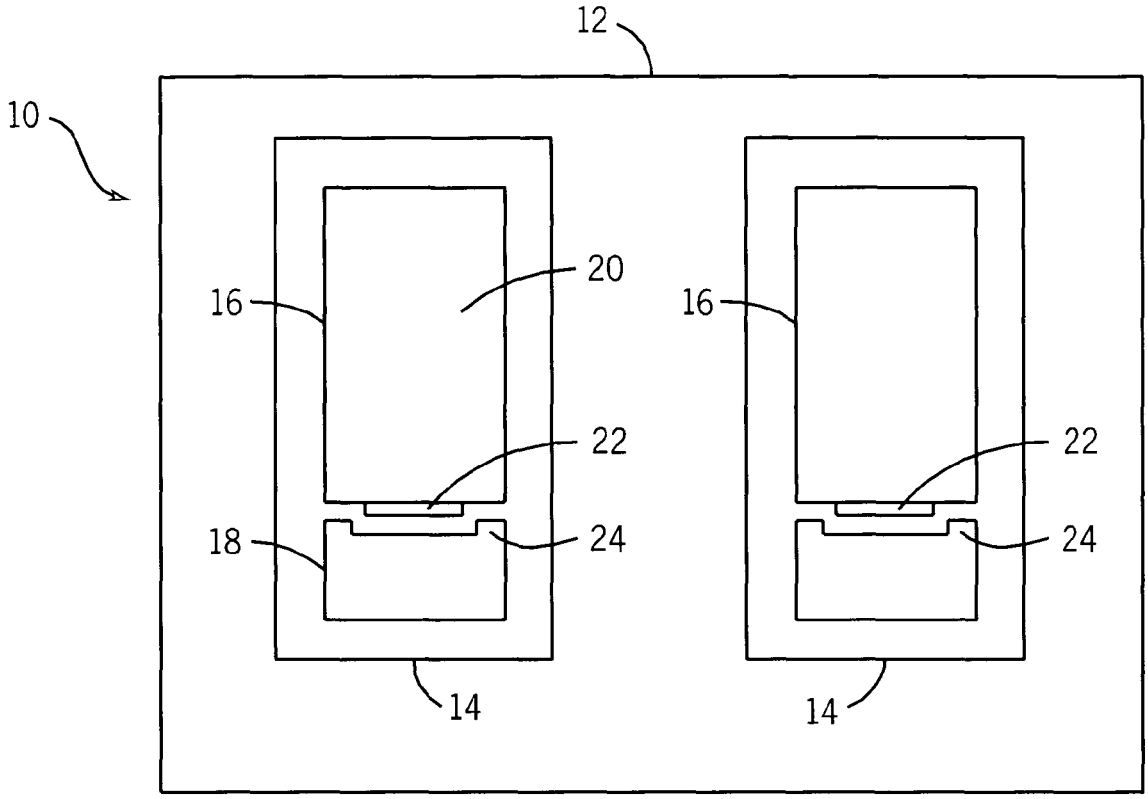
FIG. 1 is a schematic illustration of a storage system according to one example embodiment.

FIG. 1 schematically illustrates one example of a storage system 10 configured to store and maintain a print cartridge and a printhead service unit. Storage system 10 includes tray 12 and one or more storage units 14. Tray 12 holds individual storage units 14 in a modular fashion so they may be inserted for storage or removed for use. Tray 12 offers the ability to securely retain storage units 14 for convenient access. In some embodiments, tray 12 may be configured to retain multiple storage units 14. In other embodiments, tray 12 may be configured to retain a single storage unit 14. In still other embodiments, tray 12 may be omitted while storage units 14 are retained by other means or stand alone.

Storage units 14 are each configured to store a cartridge 16 and a printhead servicer 18 when not in use by a printing system. Cartridge 16 is a device configured to store and deposit printing material, such as ink, upon a medium, such as paper or other suitable material. Cartridge 16 generally includes storage chamber 20 and printhead 22. Storage chamber 20 is the portion of cartridge 16 that stores printing material to be deposited. Printhead 22 is the portion of cartridge 16 through which printing material is ejected. Cartridge 16 may be any suitable cartridge of use in commercial, industrial, or home printing systems.

Printhead servicer 18 constitutes a device configured to cap printhead 22 so as to inhibit air flow to printhead 22. In one embodiment, servicer may perform other functions such as providing a wiper or spittoon. In other embodiments, fewer functions may be provided by servicer 18. In one embodiment, servicer 18 forms a substantially air tight seal about printhead 22. Printhead servicer 18 includes capper 24, which caps printhead 22 by sealing the perimeter of printhead 22 with its edges to form a substantially airtight seal. This capping may reduce or prevent the printing material stored inside cartridge 16 from drying out during storage. Capper 24 decaps printhead 22 when cartridge 16 is to be used for printing.

In one example embodiment, printhead servicer 18 is the same device used to service cartridge 16 when in use by a printing system and thus both the cartridge 16 and printhead servicer 18 may be removed from a printing system for storage. In another embodiment, printhead servicer 18 may be a different printhead servicer than is used in a printing system. In other embodiments, printhead servicer 18 may include additional elements to maintain, protect, or service cartridge 16 so that print quality may be maintained when cartridge 16 is used for printing. In still other embodiments, capper 24 may be omitted from printhead servicer 18.

Figure 2:
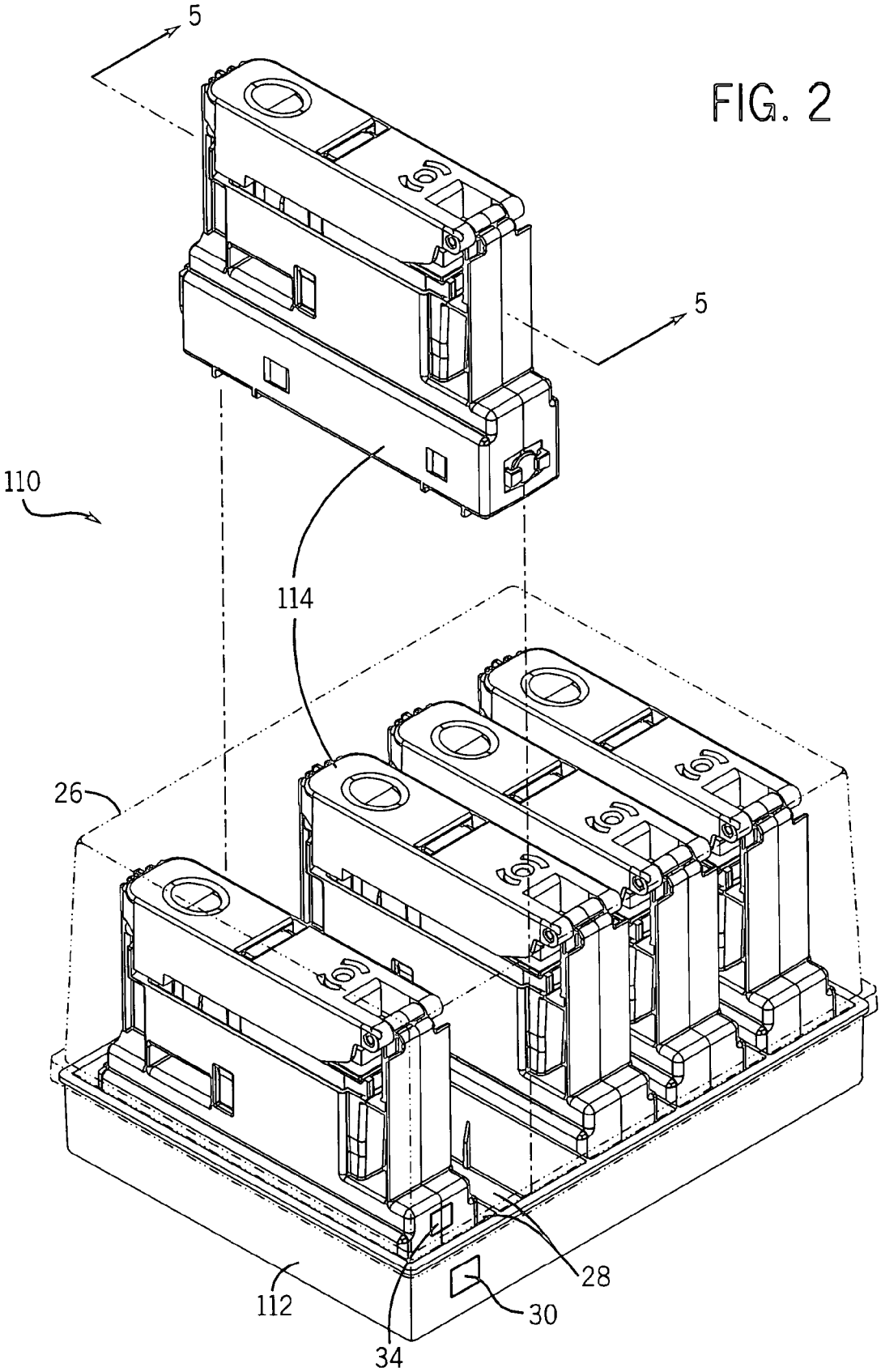
FIG. 2 is a perspective of another embodiment of the storage system of FIG. 1 according to one example embodiment.

FIG. 2 illustrates storage system 110, an example embodiment of storage system 10 shown in FIG. 1. Storage system 110 generally includes example tray 112, one or more example storage units 114, and cover 26 (shown in phantom). Tray 112 forms one or more recesses or wells 28 that hold individual storage units 114. In one embodiment, tray 112 is an integrally molded single unitary thermoplastic body. In another embodiment, tray 112 may be non-integrally molded with separate portions acting as dividers and fastened to a base to form wells 28. In other embodiments, tray 112 may be made of another material such as a non-thermoresistive plastic or a metal. In still another embodiment, tray 112 may include identifiers 30 in order to match each storage unit 114 with a corresponding well 28.

Figures 3, 4:
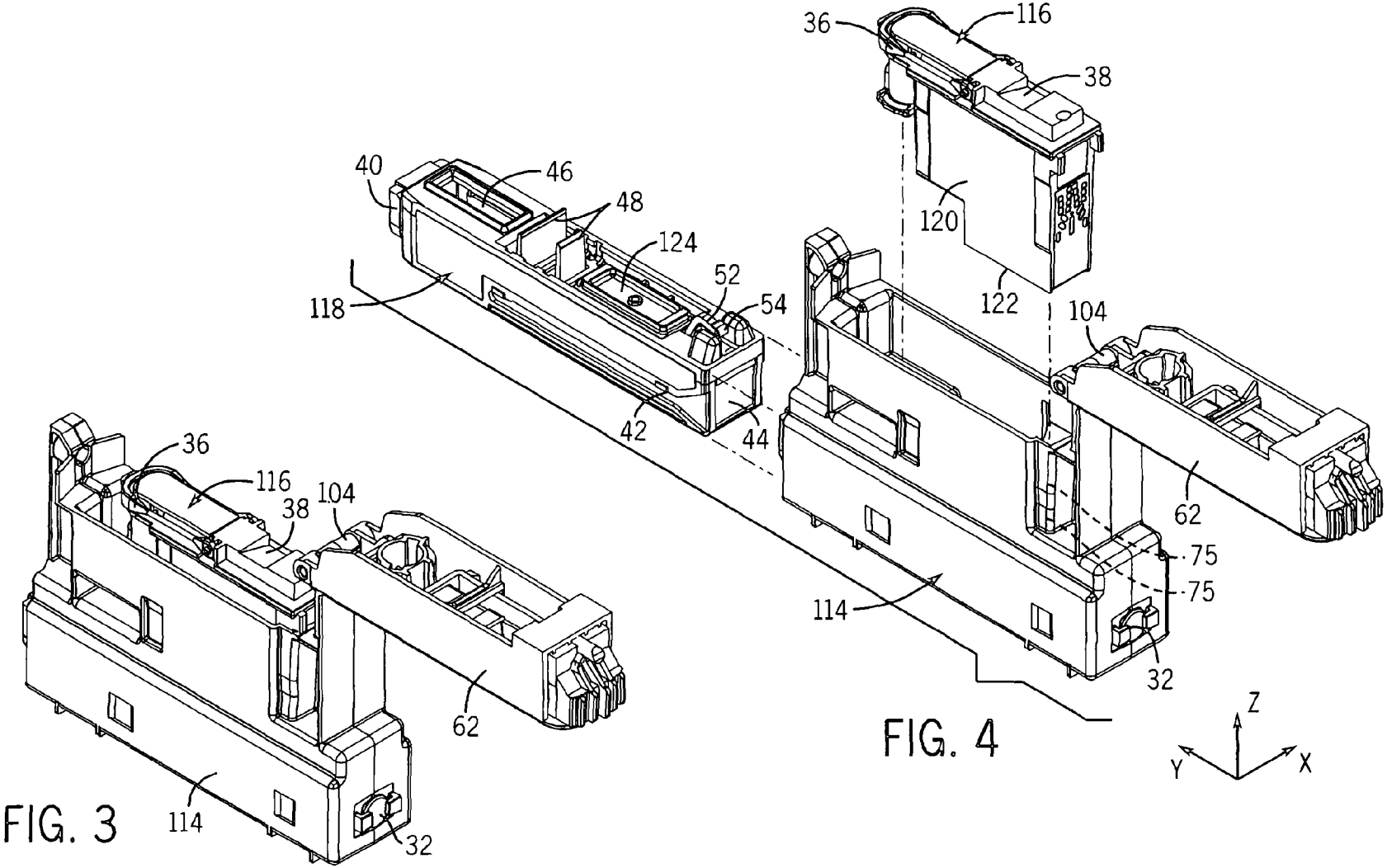
FIG. 3 is a perspective view of a storage unit of the storage system of FIG. 2 with a latch open showing a stored cartridge according to one example embodiment.
FIG. 4 is a perspective view of the storage unit of FIG. 3 with a cartridge and printhead servicer removed according to one example embodiment.
Figure 5:
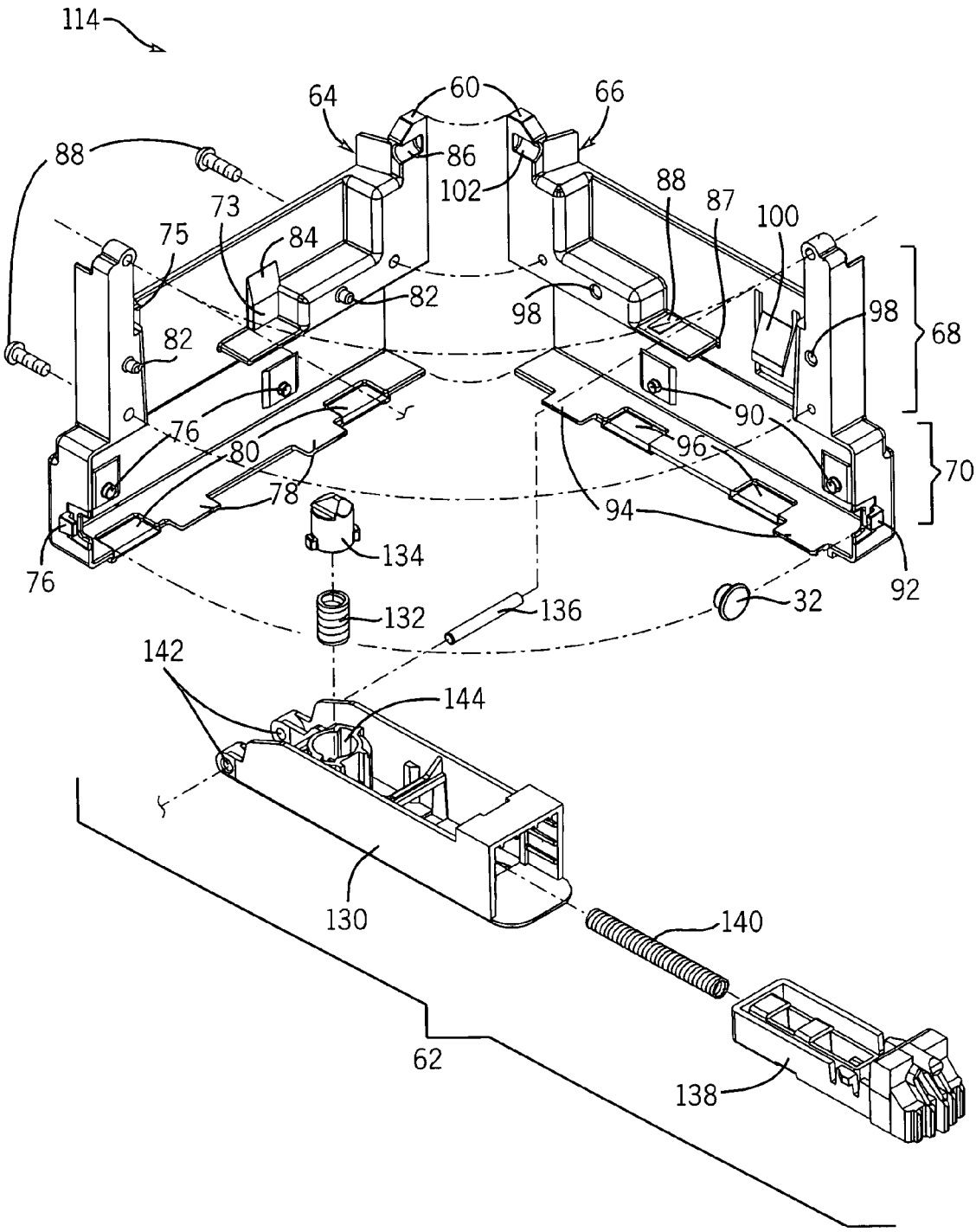
FIG. 5 is an exploded view of the storage unit of FIG. 3 according to one example embodiment.
Figure 6:
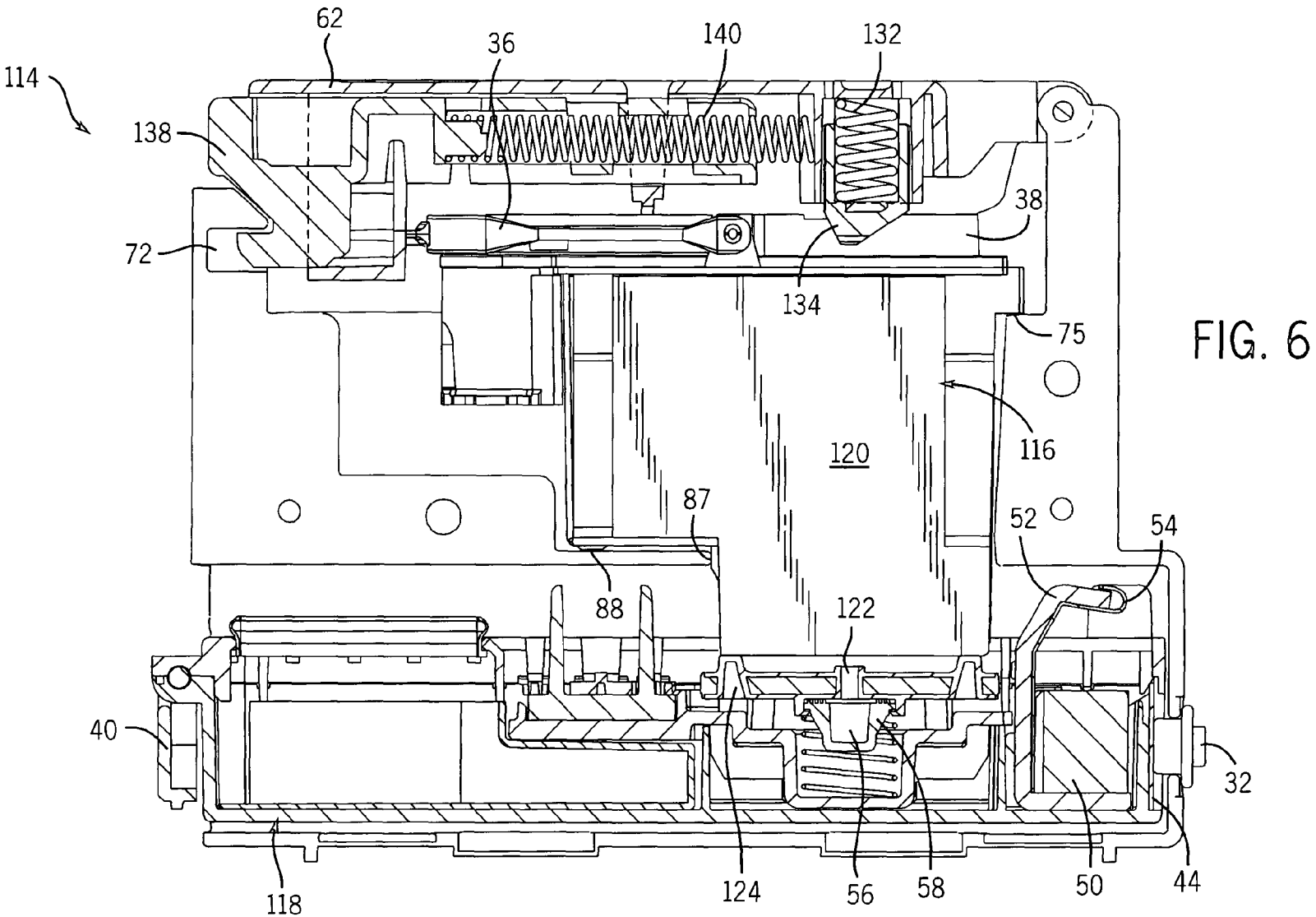
FIG. 6 is a side sectional view of a storage unit enclosing a cartridge and a printhead servicer according to one example embodiment.

Storage units 114 each retain an example cartridge 116 and an example printhead servicer 118 as shown in FIGS. 3, 4, and 6. Storage units 114 generally include magnet 32 (FIGS. 3-6) to facilitate retention of printhead servicer 118 (as discussed below with reference to FIGS. 3-6). Storage units 114 may be individually inserted into a corresponding well 28 for storage when cartridge 116 is not in use by a printing system and removed from wells 28 when cartridge 116 is to be used for printing. In one embodiment, each storage unit 114 may include an identifier 34. The identifiers are used to indicate parameters about the ink in enclosed cartridge 116 such as color or type so that a storage unit 114 is stored in the proper well 28 according to a corresponding identifier 30 on tray 112. For example, if cartridge 116 in storage unit 114 contains blue ink, identifier 34 would indicate "blue" by color, text, or other suitable manner and appropriately correspond to identifier 30 on tray 112, which indicates "blue" as well. As a result, cartridge 116 can be removed without confusion as to the color or type of ink in cartridge 116. In one embodiment, identifier 34 may be a material, such as a sticker, affixed to a storage unit 114. In other embodiments identifier 34 may be molded as a part of a storage unit 114.

Cover 26 encloses storage units 114 on tray 112 to protect storage units 114 from harm, as may be caused by dust, for example, and to secure storage units 114 in wells 28. In one embodiment, cover 26 is an integrally molded single unitary thermoplastic body. In other embodiments, tray 112 may be made of another material such as a non-thermoresistive plastic or a metal. In still other embodiments, cover 26 may be omitted, with storage units 114 left open to the environment while stored on tray 114.

FIGS. 3 and 4 illustrate cartridge 116 and printhead servicer 118 in greater detail. FIG. 3 illustrates cartridge 116 positioned in storage unit 114. As shown in FIG. 4, cartridge 116 generally includes a handle 36, an angled section 38, storage chamber 120, and printhead 122. Handle 36 projects from the sides of cartridge 116 and is configured to facilitate grasping of cartridge 116 for insertion or removal. Angled section 38 is used to secure cartridge 116 within storage unit 114 (as shown in FIG. 6). Storage chamber 120 holds the ink to be deposited onto a printing material during printing. Printhead 122 is the portion of the cartridge at which printing material is ejected for deposit onto a printing material.

FIG. 4 illustrates storage unit 114 with cartridge 116 and printhead servicer 118 removed. Cartridge 116 is configured to be inserted into and removed from storage unit 114 using handle 36 as shown by the broken lines extending from storage unit 114 to cartridge 116. In other embodiments, cartridge 116 may not include handle 36, but may be inserted and removed by other means.

Printhead servicer 118 is configured to slide in and out of storage unit 114 as shown by the broken lines (FIG. 4) extending from storage unit 114 to printhead servicer 118. As a result, printhead servicer 118 may be easily inserted into or removed from storage unit 114. Printhead servicer 118 generally includes handle 40, grooves 42, ferrous section 44, spittoon 46, wipers 48, sponge 50 (FIG. 6), wick 52, wick spring 54, and exemplary capper 124.

Handle 40 projects from an end of printhead servicer 118 and is configured for easy grasping of printhead servicer 118 for removal from storage unit 114. In other embodiments, handle 40 may be omitted and printhead servicer 118 may be inserted and removed by other means. Grooves 42 include a pair of grooves, one on each side of printhead servicer 118 (opposite side groove not shown), that are used to guide printhead servicer 118 into storage unit 114.

Ferrous section 44 allows printhead servicer 118 to be secured within storage unit 114 upon insertion by magnetic attraction with magnet 32. In one embodiment, ferrous section 44 may be a ferrous plate. In other embodiments, ferrous section 44 may be of other configurations such as a post or button. Magnet 32 may be any suitable magnet sized to allow retention in storage unit 114 as shown in FIG. 5. In another example embodiment, the placement of ferrous section 44 and magnet 32 may be reversed with ferrous section 44 attached to storage unit 114 and magnet 32 attached to printhead servicer 118.

Spittoon 46, wipers 48 sponge 50 and wick 52 service a printhead while the printhead is in a printing device. Spittoon has an opening configured to receive fluid, such as ink, spit by cartridge 116 to reduce clogging or ink buildup Wipers 48 are made of generally flexible elastomeric blades configured to wipe cartridge 116. Sponge 50 is filled with any non-evaporating oil such as polyethylene glycol for wick 52 Wick 52 lubricates wipers 48 prior to wipers 48 wiping the nozzles of the printhead to increase the effectiveness of such wiping and to reduce damage, such as scratches, to the nozzles from dried ink and dust.

Capper 124 is configured to seal the perimeter of printhead 122 of cartridge 116 by compressing elastic edges, such as rubber, of capper 124 in order to form a substantially airtight seal. This capping is intended to prevent the printing material stored inside cartridge 116 from drying out during storage. In particular, when printhead servicer 118 is inserted into storage unit 114, storage unit 114 urges cartridge 116 and servicer 118 towards one another such that the elastic edges of capper 124 are forced against printhead 122 of inserted cartridge 116, to compressing the elastic portion of capper 124 around printhead 122 to create the substantially airtight seal as shown in FIG. 6. Capper 124 de-caps printhead 122 when cartridge 116 is to be used for printing. When printhead servicer 118 is removed from storage unit 114, the force exerted against printhead 122 is removed and thus the substantially airtight seal formed around printhead 122 by compression of capper 124 is also removed. Capper includes vent hole 56 (FIG. 6), and rubber sealing 58 (FIG. 6).

Vent hole 56 is a portion of capper 124 held in place by rubber sealing 58 that functions to maintain air pressure within cartridge 116 when printhead 122 is capped. In particular, vent hole 56 permits escape of air to prevent or reduce air pressure spikes and undesirable injection of air into the nozzles which may otherwise deprime the nozzles and interfere with subsequent printing operations.

Although printhead servicer 118 is illustrated as providing spitting, wiping, and capping functions, printhead servicer 118 may provide fewer or greater of such servicing operations. In one example embodiment, printhead servicer 118 is the same device used to service cartridge 116 when in use by a printing system and thus both the cartridge 116 and printhead servicer 118 may be removed from a printing system for storage. In another embodiment, printhead servicer 118 may be a different printhead servicer than is used in a printing system.

FIGS. 3-5 illustrate storage unit 114 in greater detail. FIGS. 3 and 4 illustrate insertion of cartridge 116 and printhead servicer 118 into storage unit 114. FIG. 5 illustrates an exploded view of storage unit 114. Storage unit 114 includes a housing 60 and latch 62. Housing 60 is the portion of storage unit 114 that retains cartridge 116 and printhead servicer 118. Housing 60 is divided into two similar halves 64 and 66, to provide for ease of manufacturing. Halves 64 and 66 come together to form an upper chamber 68 to receive cartridge 116, a lower chamber 70 to receive printhead servicer 118, and receptacle 72 (FIG. 6). In other embodiments, housing 60 may be made of more than two portions or may be integrally molded together.

As shown by FIG. 5, half 64 includes datums 73, 74, 75 and 76, clasp 77, tabs 78, notches 80, protrusions 82, ramp 84, and recession 86. Datums 73-76 engage and position cartridge 116 and printhead servicer 118 with respect to one another. Datum 73 engages a side of cartridge 116 (shown in FIG. 6) to appropriately position cartridge 116 along an X-axis as seen in FIG. 4. Datums 75 (shown in FIG. 4) also engage the inner sides of cartridge 116 (shown in FIG. 4) to facilitate a desired positioning of cartridge 116 along the X-axis as shown in FIG. 4. Datum 75 is configured to engage an underside of print cartridge 116 to position cartridge 116 along the Z-axis shown in FIG. 4. Datums 76 cooperate with half 66 to guide inserted printhead servicer 118 (shown in FIGS. 4) into storage unit 114. Datums 76 fit into one of grooves 42 so that printhead servicer 118 does not move too far in either a vertical or horizontal direction and easily fits within housing 60.

Clasp 76 cooperates with half 66 to secure magnet 32 within housing 60. In other embodiments, clasp 76 may be omitted where other means or mechanisms are used to secure magnet 32.

Tabs 78, notches 80, protrusions 82, and fasteners 88 are used to secure half 64 with half 66. Tabs 78 and notches 80 mate with half 66 in order to secure half 64 with half 66. Protrusions 82 mate with half 66 to further secure half 64 to half 66. It should also be noted that while in the illustrated example embodiment fasteners 88 are shown to be screws, in other embodiments other fasteners, such as pins, may be used.

Ramp 84 is configured to press inserted cartridge 116 against half 66 so that cartridge 116 is held upright and secured properly. In the illustrated embodiment, ramp 84 has a sloped surface that guides cartridge 116 into storage unit 114 into position against datum 73. As cartridge 116 is inserted into storage unit 114, the sloped portion of ramp 84 makes contact with cartridge 116 to guide it inwards during insertion in order to press it against half 66. In one embodiment, ramp 84 is integrally molded as a single unitary body with half 64. In other embodiments, ramp 84 may not be integrally molded, but instead affixed in some manner to half 64. Recession 86 cooperates with half 66 to form receptacle 72, which receives and secures latch 62 in a closed position (as shown in FIG. 6).

Half 66 includes datums 87, 88 and 90, clasp 92, tabs 94, notches 96, receptacles 98, spring 100, and recession 102. Datum 87 constitutes an edge configured to abut the side portion of cartridge 116 so as to properly locate cartridge 116 along the Y-axis as seen in FIG. 4. Datum 88 constitutes a pad configured to contact an underside of cartridge 116 to facilitate the proper positioning of cartridge 116 (shown in FIG. 4) in the Z-axis direction as seen in FIG. 4. Datum 88 constitutes a raised platform configured to engage an underside of print cartridge 116 (shown in FIG. 4) so as to properly position print cartridge 116 along the Z-axis shown in FIG. 4. Datums 90 cooperate with datums 76 to guide inserted printhead servicer 118 (shown in FIG. 4) into storage unit 114. Datums 90 fit into one of grooves 42 on the opposite side of printhead servicer 118 that datums 76 fit into so that printhead servicer 118 does not move too far in either a vertical or horizontal direction and easily fits within housing 60.

Overall, datums 73-76 and datums 87-90 facilitate proper positioning of cartridge 116 and printhead servicing unit 118 within storage unit 114. In other embodiments, such datums may have other configurations and may have other locations. In some embodiments, some of such datums may be omitted. For example, in one embodiment, more or fewer than two datum may be used on each half 64 and 66 to guide printhead servicer 118 into storage unit 114. In another embodiment, datums 76 and 90 may be of another shape such as ridges along a substantial length of halves 64 and 66. In other embodiments, datums 76 and 90 may be a part of printhead servicer 118 and grooves 42 a part of storage unit 114. In still other embodiments, datums 76 and 90 and grooves 40 may be omitted altogether.

Clasp 92 cooperates with clasp 76 to secure magnet 32 within housing 60. In other embodiments, clasps 76 and 92 may be of a different form than illustrated in FIGS. 4 and 5. In another embodiment, clasps 76 and 92 may be omitted and magnet 32 may be retained in housing 60 using other means such as an adhesive.

Tabs 94, notches 96, and receptacles 98 are used to secure half 66 with half 64. Tabs 94 mate with notches 80 of half 64 and notches 96 mate with tabs 78 of half 64 in order to secure half 64 with half 66. Receptacles 98 receive protrusions 82 from half 64 to further secure halves 64 and 66. In another example embodiment, more or fewer than two tabs and notches may be used on each half to secure halves 64 and 66 together. In other embodiments, tabs 78 and 94 and notches 80 and 96 may be omitted and halves 64 and 66 secured by other means. In another example embodiment, more or fewer than two protrusions 82 and receptacles 98 may be used to secure halves 64 and 66 together. In still other embodiments, protrusions 82 and receptacles 98 may be omitted and halves 64 and 66 secured together via other means.

Spring 100 is configured to press inserted cartridge 116 against datum 84 of half 64 so that cartridge 116 is held upright and secured properly. In the illustrated embodiment, spring 100 is a leaf spring integrally molded with storage unit 114. In other embodiments, spring 100 may be another type of spring, such as a compression spring, and may be non-integrally attached to storage unit 114. In another example embodiment, spring 100 and datum 84 may be reversed where datum 84 is a part of half 66 and spring 100 a part of half 64.

Recess 102 cooperates with recess 86 of half 64 to form receptacle 68, which receives and secures latch 62 in a closed position (as shown in FIG. 6). In the illustrated embodiments, recesses 86 and 102 are of a hemispherical shape. In other embodiments, recesses 86 and 102 may be of another shape such as to conform with latch 62.

As illustrated in FIGS. 3 and 4, latch 62 is configured to retain cartridge 116 in storage unit 114. In the illustrated embodiment, latch 62 rotates around hinge 104 by applying a force to angled section 38 (as shown in FIG. 6). In another embodiment, latch 62 may rotate about a hinge on the opposite side of storage unit 114 while still retaining cartridge 116. In other embodiments, latch 62 may not rotate about a hinge, but could be a separate piece that snaps on the top of cartridge 116 while still retaining cartridge 116 in storage unit 114. In still other embodiments, latch 62 may be omitted and cartridge 116 secured in storage unit 114 without a force applied from above.

As illustrated in FIG. 5, latch 62 generally includes housing 130, spring 132, button 134, pin 136, member 138, and spring 140. Housing 130 forms holes 142 and receptacle 144. Pin 136 passes through holes 142 to form a hinge that latch 62 may rotate around into open and closed positions (as shown in FIGS. 3 and 6, respectively). Receptacle 144 receives and secures spring 132 and button 134. Button 134 has an angled surface configured to press on angled section 36 of cartridge 116 (as shown in FIG. 6) due to the bias of spring 132. When latch 62 is rotated to the closed position, the angled surface of button 134 is used to retain cartridge 116 (as shown in FIG. 6) within storage unit 114 and against datums.

Member 138 holds latch 62 in a closed position. When member 138 is slid into housing 130, spring 140 provides a bias pushing member 138 outward from housing 130. When latch 62 is closed, member 138 is manually pushed inwards so it may join with receptacle 68 (shown in FIG. 6). Thereafter, spring 140 pushes member 138 outwards, which locks into receptacle 68 (shown in FIG. 6), securing latch 62 into the closed position. In other embodiments, latch 62 may be secured into the closed position using devices other than the illustrated spring-biased member 138 such as a clip.

FIG. 6 is a cross-sectional view illustrating storage unit 114 interacting with and retaining cartridge 116 with respect to printhead servicer 118. As shown in FIG. 6, cartridge 116 is securely retained within storage unit 114, when not used for printing, by button 134 of latch 62, which is pressed down on angled section 38 by spring 132. Latch 62 is held closed by member 138, which mates with receptacle 68. Latch 62 can easily be opened to remove cartridge 116 when needed for printing by simply applying pressure on member 138, lifting latch 62, and lifting cartridge 116 by handle 34.

Printhead servicer 118 may be the same servicer used by cartridge 116 within a printing system so that cartridge 116 and printhead servicer 118 may be kept together both when in use and in storage. Printhead servicer 118 is easily slid in and out of storage unit 114 using handle 40. When printhead servicer 118 is removed, wick 52 uses oil from sponge 50 to clean cartridge 116 using a pressure applied form wick spring 54. This cleaning may permit printhead 122 to be kept clean. Printhead servicer 118 is securely retained within storage unit 114 by the magnetic attraction given between ferrous plate 44 and magnet 32 so that it cartridge 116 is continually maintained and serviced when in storage.

When printhead servicer 118 is in storage unit 114, capper 124 effectively caps printhead 122 of cartridge 116 by sealing the perimeter of printhead 122. Storage unit 114 precisely aligns nozzles of the print cartridge 116 with capper 124 of servicing unit 118 and depresses capper 124 by a desired amount such that a desired capping force is applied about the nozzles. Vent hole 56 reduces air pressure spikes during initial capping to reduce injection of air into nozzles (and potential depriming of the nozzles).

Figure 7:
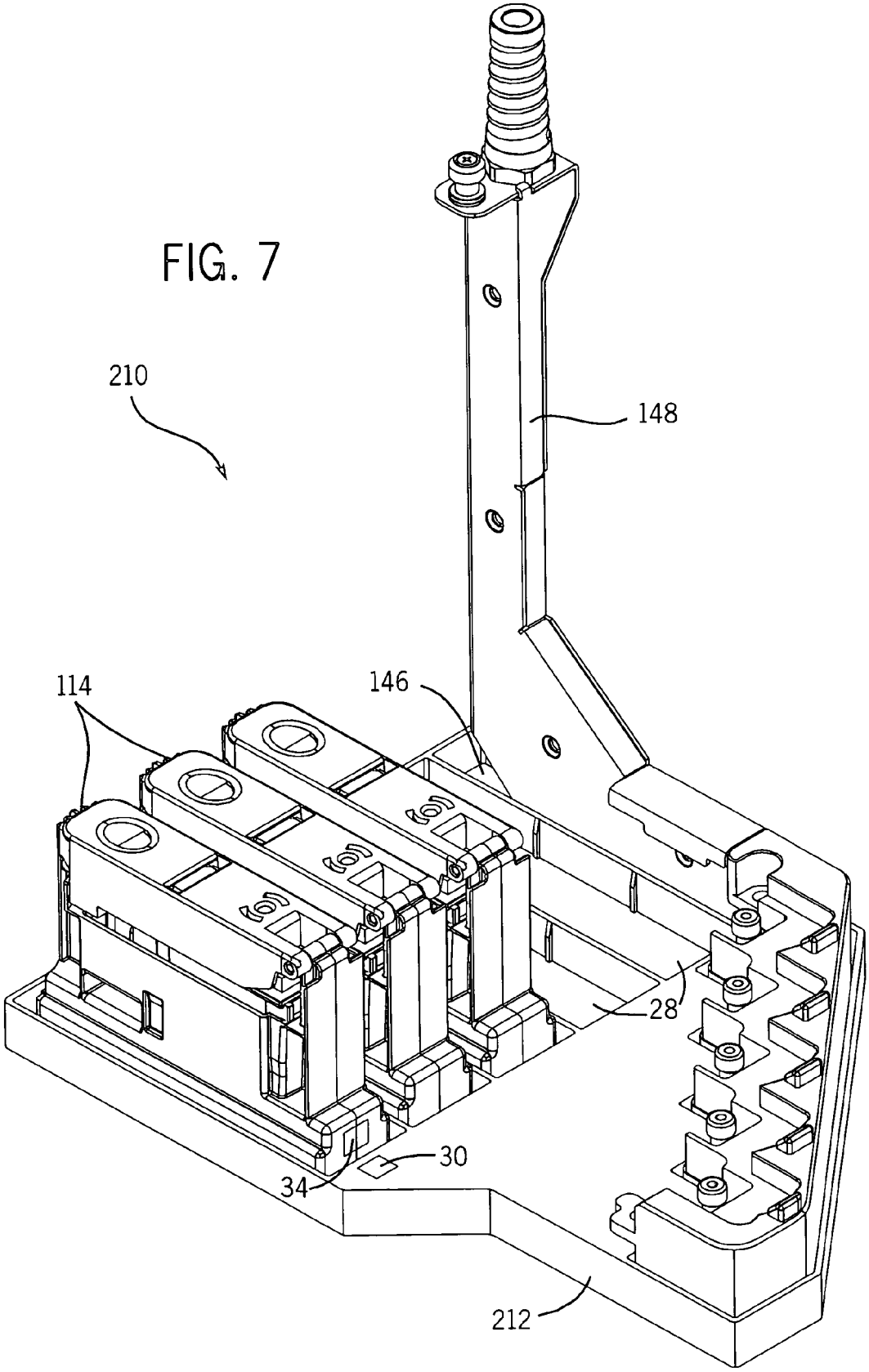
FIG. 7 is perspective of another embodiment of the storage system of FIG. 1 according to one example embodiment.

FIG. 7 illustrates storage system 210, another example embodiment of storage system 10 in FIG. 1. Storage system 210 includes tray 212 and one or more storage units 114 (as described above). Tray 212 forms one or more recesses or wells 28 that hold individual storage units 114 and a well 146 that holds crane 148. In one embodiment, tray 212 is an integrally molded single unitary thermoplastic body. In another embodiment, tray 212 may be non-integrally molded with separate portions acting as dividers and fastened to a base to form wells 28. In other embodiments, tray 212 may be made of another material such as a non-thermoresistive plastic or a metal. In still another embodiment, tray 212 may include identifiers 30 in order to match each storage unit 114, which has an identifier 34 as described above, with proper well 28 in the same manner as discussed with storage system 110.

Crane 148 is used to fill cartridge 116 (shown in FIGS. 3, 4, and 6) within each storage unit 114 with ink when not in storage and used in a printing system. When crane 148 and cartridge 116 are used in a printing system, crane 148 is attached to one or more cartridges 116. Each cartridge 116 receives ink through an internal conduit within crane 148. Crane 148 is stored in well 146 formed by tray 212 so that it may be conveniently stored in a central location with the cartridges it fills when in use.

Overall, storage systems 10,110 and 210 allow for modular storage of one or more individual storage units 14 and 114, each of which holds cartridge 16 or 116 and printhead servicer 18 or 118. In the embodiment shown in FIGS. 1, 4, and 6, systems 10,110 and 210 facilitate servicing of cartridges 16 and 116 while being stored so that the ink in cartridges 16 and 116 does not dry out.

Additionally, as shown in FIGS. 4 and 6, systems 110 and 210 service cartridge 116 using printhead servicer 118 to prevent the ink in cartridge 116 from including air bubbles and to keep cartridge 116 clean. In the embodiment shown in FIG. 2, systems 110 and 210 identify each storage unit 114 with each well 28 such as by color-coding so that the ink colors or type of cartridge 116 within each storage unit 116 are not mixed up during storage. In the embodiment shown in FIG. 5, systems 110 and 210 provide relative ease of manufacturing of storage unit 114 due to halves 64 and 66 being separately molded and secured together.

System 210 additionally facilitates storing crane 148, which refills cartridges 116 when in a printing system, with storage units 114. Storing crane 148 with storage units 114 allows for a central storage location of cartridge 116, printhead servicer 118, and crane 148 for easy access when cartridges 116 are to be used again in a printing system.

Although systems 10,110 and 210 are illustrated as including multiple features utilized in conjunction with one another, systems 10,110 and 210 may alternatively utilize less than all of the noted mechanisms or features. For example, in other embodiments, capper 124 may alternatively be permanently configured as part of storage unit 114. In still other embodiments, storage unit 114 may alternatively be configured to removably receive a servicer that merely provides capper 124.

The present disclosure has been described with reference to example embodiments, however workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. A storage system comprising:

a tray; and storage units within the tray, each storage unit configured to removably store a printing system servicer removed from a printing system and a corresponding cartridge removed from the printing system with nozzles of the cartridge capped by a capping mechanism of the printing system servicer, wherein each storage unit is configured to be removed from the tray while at least one other of the storage units remain within the tray.

2. The system of claim 1, wherein each storage unit includes:

a lower chamber configured to receive the printing system servicer; and an upper chamber configured to receive the corresponding cartridge, wherein the lower chamber and the upper chamber are substantially formed from opposite halves joined to one another and wherein each half is integrally formed as a single unitary body and includes a portion of the lower chamber and a portion of the upper chamber.

3. The system of claim 2, wherein the printing system servicer includes one of a pair of grooves and projections, wherein the lower chamber includes the other of the pair of grooves and projections and wherein the grooves slidably receive the projections to guide insertion of the printing system servicer into the lower chamber.

4. The system of claim 1, wherein each storage unit includes a lower chamber configured to receive the printing system servicer and an upper chamber configured to receive the cartridge, wherein the lower chamber and the upper chamber are substantially formed from opposite halves joined to one another and wherein each half includes a portion of the lower chamber and a portion of the upper chamber.

5. The system of claim 1, wherein the printing system servicer includes one of a magnet and a magnetic attractable material and wherein each storage unit includes the other of the magnet and the magnetic attractable material, wherein the magnet and the magnetically attractable material are configured to retain the printing system servicer within the storage unit.

6. The system of claim 5, wherein each storage unit includes the magnet.

7. The system of claim 1, wherein each storage unit includes a spring configured to bias a cartridge to a position within the storage unit.

8. The system of claim 7, wherein the spring is integrally formed as a single unitary body with a remainder of the storage unit.

9. The system of claim 1, wherein each storage unit includes a latch pivotal between an open position permitting the cartridge to be inserted into the unit and a closed position retaining the cartridge within the unit.

10. The system of claim 9, wherein each latch is configured to urge the cartridge, when inserted, towards the printing system servicer, when inserted.

11. The system of claim 1, wherein each storage unit includes a label identifying a color of ink in the cartridge stored in the storage unit.

12. The system of claim 1, wherein the tray includes wells configured to receive the storage units.

13. The system of claim 1, wherein the tray is configured to removably receive an ink supply conduit for each of the cartridges.

14. The system of claim 1, wherein each of the storage units are structurally identical to one another.

15. The system of claim 1, wherein each storage unit is configured to be removed from the tray while at least one other of the storage units remain within the tray.

16. A storage unit comprising:

a lower chamber configured to receive printing system servicer having a cartridge capping mechanism, wherein the lower chamber is configured to contact the printing system servicer while guiding movement of the printing system servicer in a first direction during insertion of the printing system servicer into the lower chamber; and an upper chamber configured to receive and to contact a corresponding cartridge while guiding movement of the cartridge in a second direction substantially perpendicular to the first direction during insertion of the cartridge into the upper chamber, wherein at least a portion of the upper chamber and the lower chamber are integrally formed with one another as a single unitary body, wherein the lower chamber and the upper chamber are substantially formed from opposite halves joined to one another and wherein each half includes a portion of the lower chamber and a portion of the upper chamber.

17. The storage unit of claim 16, wherein the printing system servicer includes one of a pair of grooves and projections, wherein the lower chamber includes the other of the pair of grooves and projections and wherein the grooves slidably receive the projections to guide insertion of the servicer into the lower chamber.

18. The storage unit of claim 16, wherein the printing system servicer includes one of a magnet and a magnetic attractable material, wherein the storage unit includes the other of the magnet and the magnetically attractable material and wherein the magnet and the magnetically attractable material are configured to retain the servicer within the storage unit.

19. The storage unit of claim 16 further comprising a spring configured to bias the corresponding cartridge to a position within the storage unit.

20. The storage unit of claim 19, wherein the spring is integrally formed as a single unitary body with a remainder of the storage unit.

21. The storage unit of claim 16 further comprising a latch pivotable between an open position permitting the corresponding cartridge to be inserted into the storage and a closed position retaining the corresponding cartridge within the storage unit.

22. The storage unit of claim 21, wherein the latch is configured to urge the corresponding cartridge, when inserted, towards the printing system servicer, when inserted.

23. The storage unit of claim 16 further comprising a label identifying an ink in the corresponding cartridge to be stored in the storage unit.

24. A storage system comprising:

means for removably receiving a printing system servicer having a capping mechanism, wherein the lower chamber is configured to contact the printing system servicer while guiding movement of the servicer in a first direction during insertion of the printing system servicer into the lower chamber; and means for removably receiving a cartridge with nozzles while contacting the cartridge and guiding movement of the cartridge in a second direction substantially perpendicular to the first direction during insertion of the cartridge into the means for removably receiving the cartridge, the means for removably receiving the cartridge locating the nozzles in contact with the capping mechanism, wherein the means for removably receiving the printing system servicer and the means for removably receiving the cartridge are substantially formed from opposite halves joined to one another and wherein each half includes a portion of the means for removably receiving the printing system servicer and a portion of the means for removably receiving the cartridge.

25. A method comprising:

retaining a first printing system servicer in a first storage unit;

retaining a first cartridge in the first storage unit; and removably retaining the first storage unit, proximate a second storage unit, from a tray while the second storage unit remains within the tray, the second storage unit retains a second printing servicer and a second cartridge.

26. The method of claim 25 further comprising:

removably retaining the second storage unit in place of the first storage unit.

27. The method of claim 25 further comprising resiliently biasing the cartridge to a first position in the first storage unit.

28. The method of claim 25 further comprising magnetically retaining the first printing system servicer in the first storage unit with a magnet.

29. A storage system comprising:

a tray; and storage units within the tray, each storage unit configured to store a printing system servicer and a corresponding cartridge with nozzles of the cartridge capped by a capping mechanism of the printing system servicer, wherein the servicer includes one of a magnet and a magnetic attractable material and wherein each storage unit includes the other of the magnet and the magnetic attractable material, wherein the magnet and the magnetically attractable material are configured to retain the printing system servicer within the storage unit.

30. The system of claim 29, wherein each storage unit includes the magnet.

* * * * *

UNITED STATES PATENT AND TRADEMARK OFFICE

CERTIFICATE OF CORRECTION

PATENT NO. : 7,731,326 B2
APPLICATION NO. : 11/256248
DATED : June 8, 2010
INVENTOR(S) : Raul Perez et al.

It is certified that error appears in the above-identified patent and that said Letters Patent is hereby corrected as shown below:

In column 9, line 18, in Claim 16, after "receive" insert -- a --.

In column 10, line 11, in Claim 24, after "the" insert -- printing system --.

In column 10, line 50, in Claim 29, after "the" insert -- printing system --.

Signed and Sealed this

Thirtieth Day of November, 2010

David J. Kappos

David J. Kappos
*Director of the United States Patent and Trademark Office*